United States Patent [19]

Eberhardt

[11] 4,134,010

[45] Jan. 9, 1979

[54] BISTABLE IMAGE TUBE

[75] Inventor: Edward H. Eberhardt, Fort Wayne, Ind.

[73] Assignee: International Telephone & Telegraph Corp., Nutley, N.J.

[21] Appl. No.: 800,771

[22] Filed: May 26, 1977

[51] Int. Cl.[2] ..... H01J 31/50

[52] U.S. Cl. ..... 250/213 VT; 315/10

[58] Field of Search ..... 250/207, 213 R, 213 VT; 315/10, 11; 313/94, 95

[56] References Cited

U.S. PATENT DOCUMENTS

| | | | |
|---|---|---|---|
| 2,941,100 | 6/1960 | Farnsworth | 250/213 VT |
| 2,970,219 | 1/1961 | Roberts et al. | 250/213 VT |
| 3,775,636 | 11/1973 | McNally | 315/10 |
| 3,784,831 | 1/1974 | Reif | 250/213 VT |

*Primary Examiner*—David C. Nelms

*Attorney, Agent, or Firm*—John T. O'Halloran; Alfred C. Hill

[57] ABSTRACT

An array of elemental electrodes, each electrode serving in a dual manner as a light sensitive source of photoelectrons, a primary photocathode, and as a collector of electrons for an auxiliary light sensitive input photocathode, followed by a pair of accelerating-retarding field grids and a light emitting phosphor screen to convert electrons passing the retarding field grid to a visible output image. An input optical image, to be processed, impinges on the primary photocathode, while a biasing flood light is provided to excite electrons from the auxiliary photocathode acting as a control on the level at which switching to visible output brightness occurs.

13 Claims, 3 Drawing Figures

BISTABLE IMAGE TUBE

BACKGROUND OF THE INVENTION

This invention relates to image tubes and more particularly to bistable image tubes.

A cathode ray tube appropriately connected in an electronic circuit can provide a bistable image tube, but such an arrangement is responsive to an electrical input rather than being responsive to a light input.

SUMMARY OF THE INVENTION

An object of the present invention is to provide a light responsive bistable image tube.

In accordance with the present invention, a light responsive bistable image tube is provided by positioning a biasing light source so that the generated biasing light floods a photocathode and thus produces a variable photocathode current which will prevent any light output until the input light produces a corresponding photocathode current which exceeds the biasing photocathode current caused by the biasing light. Once the brightness of the input light is sufficient to produce a high enough electron current to overcome the biasing electron current the tube will switch from a no light output condition to a bright light output condition.

A feature of the present invention is the provision of a light responsive bistable image tube comprising: an elemental portion of the tube including a light input device for an element of light input; a photocathode coupled to the input device; a first grid adjacent the photocathode; a second grid adjacent the first grid remote from the photocathode; and an output phosphor screen adjacent the second grid remote from the photocathode to provide output light; and a source of biasing light disposed to have the biasing light impinge on the photocathode to produce no light output on the screen when the brightness of the light input is less than the brightness of the biasing light and to produce a bright light output on the screen when the brightness of the light input is equal to or greater than the brightness of the biasing light.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
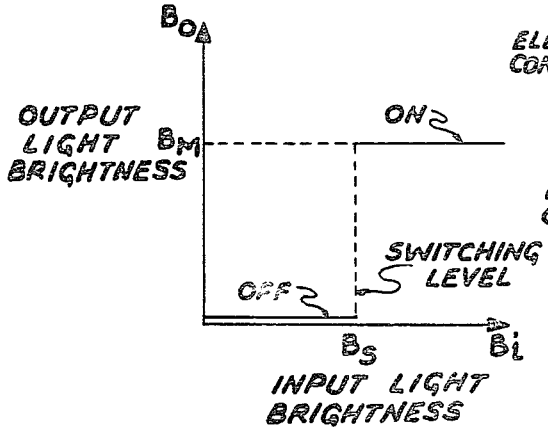
FIG. 1 is a graph illustrating the operation of the light responsive bistable image tube in accordance with the principles of the present invention.

A light responsive bistable image tube in accordance with the principles of the present invention has two output levels, "off" for low brightness input light and, "on" for bright input light that exceeds some threshold or switching level. This is illustrated in FIG. 1. When the brightness of the input light $B_i$ is less than a switching level $B_s$, the brightness of the output light $B_o$ should be zero or some minute value. When the brightness of the input light $B_i$ is greater than the brightness of the output light, then the output light $B_o$ should equal $B_M$ a fixed "on" level. Ideally, the level $B_s$ should be adjustable so that the switching can be set to any desirable level of input light. This type of device has been called an "infinite gamma" device. Other terms employed for this device are an "AND" device, i.e. one that requires two light inputs to reach the switching level $B_s$ or a "OR" device, i.e. where either input light causes switching level $B_s$ to be exceeded and causes a $B_M$ light output.

Figure 2:
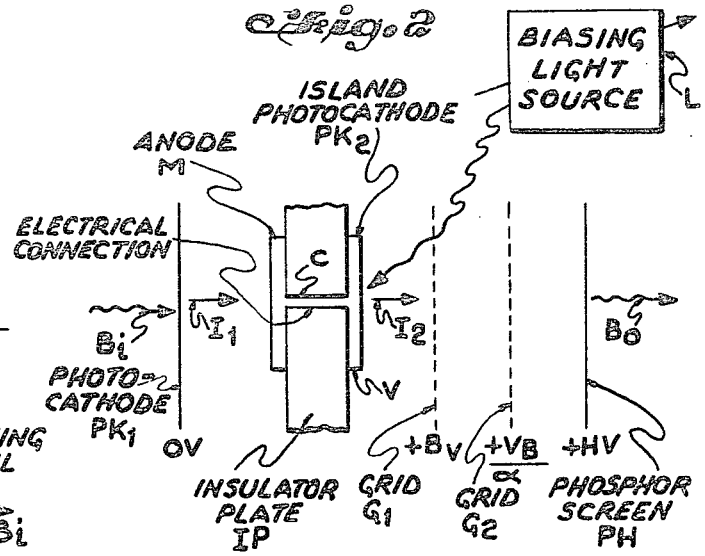
FIG. 2 is a diagrammatic illustration of an elemental portion of a light responsive bistable image tube in accordance with the principles of the present invention.
Figure 3:
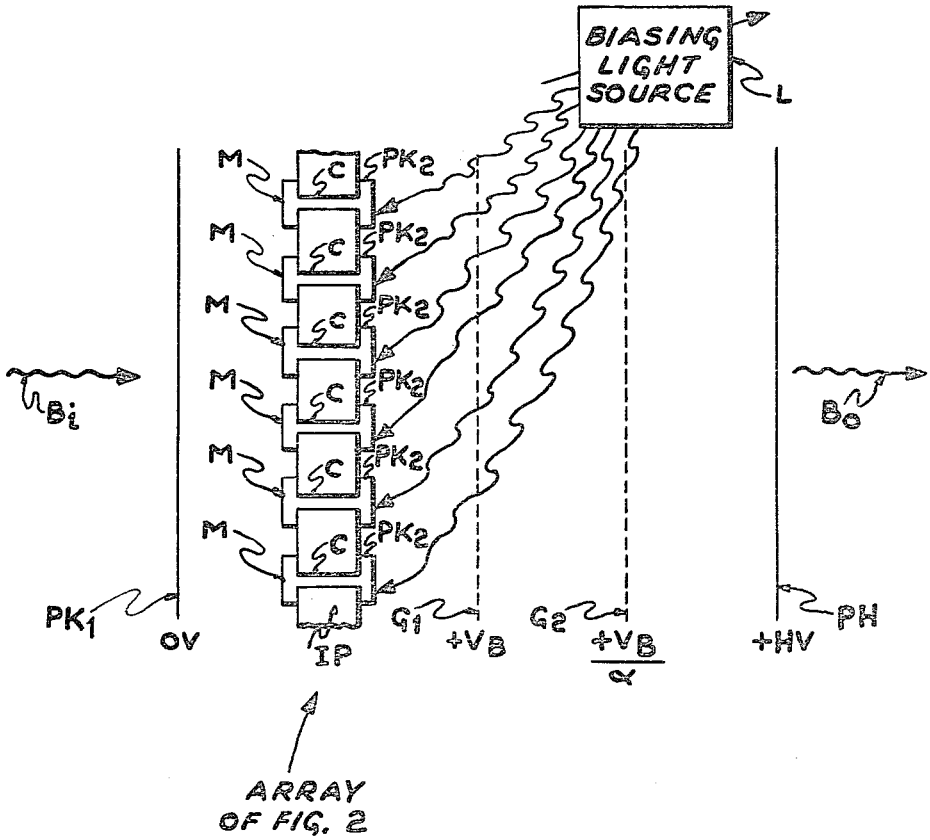
FIG. 3 is a diagrammatic illustration of an array of the elemental portion of FIG. 2 illustrating the light responsive bistable image tube in accordance with the principles of the present invention.

Referring to FIG. 2, a diagrammatic illustration is shown for an elemental portion of the light responsive bistable image tube in accordance with the principles of the present invention. A grid $G_1$ is operated at a $+V_B$ potential collecting an electron current $I_2$ from an island photocathode $PK_2$ where electron current $I_2$ is produced by the biasing light from biasing light source L. If the electron current $I_1$ from photocathode $PK_1$ is small (less than electron current $I_2$) then the potential V of photocathode $PK_2$, connected electrically to anode M, will rise to $+V_B$ potential due to transfer of the $+V_B$ potential from grid $G_1$ through means of current $I_2$ returning from grid $G_1$ to photocathode $PK_2$. The electrons in electron current $I_2$ are, therefore, unable to penetrate the second grid $G_2$ operated at a fraction $1/\alpha$ of potential $+V_B$. The output light brightness $B_o$ of phosphor screen PH operated at some potential +HV greater than the potential of grids $G_1$ and $G_2$ is therefore zero. If the input light brightness $B_i$ increases to cause an electron current $I_1$ which equals or exceeds electron current $I_2$ (the switchover point $B_s$ of FIG. 1) suddenly the potential V on photocathode $PK_2$ and anode M drops to or nearly to zero. The electrons in the electron current $I_2$ now have the full $+V_B$ energy, can penetrate grid $G_2$ and cause the desired output light brightness $B_M$. Thus, the desired switching action at $I_1 = I_2$ has been achieved as illustrated at point $B_s$ of FIG. 1. A wire, or other conductive material connects photocathode $PK_2$ through insulator plate IP to the anode M of this elemental portion of the light responsive bistable image tube. The biasing light from source L produces electron current $I_2$ and, therefore, can be used to adjust electron current $I_2$ to the desired switching level by adjusting the brightness of the biasing light. A complete light responsive bistable image tube as illustrated in FIG. 3 would be composed of an array of the elemental portions illustrated in FIG. 2, where the biasing light source L is common to all of the photocathodes $PK_2$ of the array.

There are many ways of constructing the area between photocathodes $PK_1$ and $PK_2$. The pin plates as shown in FIG. 2 with interconnecting tungsten or Kovar wires would be one such device. Conductive fiber optic plates is another device. Microchannel plates of low resistivity would be a third choice.

Several methods of preventing the biasing light from source L from reaching photocathode $PK_1$ are possible. The areas between photocathodes $PK_1$ and $PK_2$ might be opaque or an opaque coating could be evaporated over one surface which would be semiconductive passing the electron current $I_1$ axially, but resisting lateral element to element short circuiting current laterally. Another way of preventing the biasing light from source L from reaching photocathode $PK_1$ would be to introduce the biasing light into the support film of photocathode $PK_1$ so that it is trapped in the film by multiple reflections. In fact, some of the light from biasing source L could be permitted to reach photocathode $PK_1$ as long as it does not cause switchover. This is unlikely in any case since the $I_1$ electron current must exceed the $I_2$ electron current which is very unlikely since the light would have to pass completely through the photocathode $PK_2$ area.

To provide a complete commercial light responsive bistable image tube as described herein, the array of elemental portions of this tube would be enclosed in a suitable vacuum envelope (not shown).

In addition, it should be pointed out that the light responsive bistable image tube of the present invention responds to analog and digital input light to produce the desired bistable output light at phosphor screen PH.

While I have described above the principles of my invention in connection with specific apparatus it is to be clearly understood that this description is made only by way of example and not as a limitation to the scope of my invention as set forth in the objects thereof and in the accompanying claims.

I claim:

1. A light responsive bistable image tube comprising:
an elemental portion of said tube including
a first photocathode to receive an element of light input;
a second photocathode spaced from said first photocathode, said second photocathode being coupled to said first photocathode by electrons emitted from said first photocathode;
a first grid adjacent said second photocathode;
a second grip adjacent said first grid remote from said second photocathode; and
an output phosphor screen adjacent said second grid remote from said second photocathode to provide output light; and
a source of biasing light disposed to have said biasing light impinge on said second photocathode to produce no light output on said screen when the brightness of said light input is less than the brightness of said biasing light and to produce a bright light output on said screen when the brightness of said light input is equal to or greater than the brightness of said biasing light.

2. A tube according to claim 1, wherein
said second photocathode is an island photocathode.

3. A tube according to claim 2, wherein
the brightness of said biasing light is adjustable to enable selection of a switching point between no light output and bright light output on said screen.

4. A tube according to claim 3, further including
a first voltage having a predetermined positive value greater than zero coupled to said first grid; and
a second voltage having a value equal to a given fraction of said predetermined positive value coupled to said second grid.

5. A tube according to claim 4, further including
an insulator plate disposed between said island photocathode and said first photocathode, said insulator plate supporting said island photocathode on one surface thereof adjacent said first grid,
an anode supported on the other surface of said insulator plate adjacent said first photocathode, and
an electrical connection through said insulator plate connecting said anode to said island photocathode.

6. A tube according to claim 1, wherein
the brightness of said biasing light is adjustable to enable selection of a switching point between no light output and bright light output on said screen.

7. A tube according to claim 6, further including
a first voltage having a predetermined positive value greater than zero coupled to said first grid; and
a second voltage having a value equal to a given fraction of said predetermined positive value coupled to said second grid.

8. A tube according to claim 7, further including
an insulator plate disposed between said first photocathode and said second photocathode, said insulator plate supporting said second photocathode on one surface thereof adjacent said first grid,
an anode supported on the other surface of said insulator plate adjacent said first photocathode, and
an electrical connection through said insulator plate connecting said anode to said second photocathode.

9. A tube according to claim 1, further including
a first voltage having a predetermined positive value greater than zero coupled to said first grid; and
a second voltage having a value equal to a given fraction of said predetermined positive value coupled to said second grid.

10. A tube according to claim 9, further including
an insulator plate disposed between said first photocathode and said second photocathode, said insulator plate supporting said second photocathode on one surface thereof adjacent said first grid,
an anode supported on the other surface of said insulator plate adjacent said first photocathode, and
an electrical connection through said insulator plate connecting said anode to said second photocathode.

11. A tube according to claim 1, further including
an insulator plate disposed between said first photocathode and said second photocathode, said insulator plate supporting said second photocathode on one surface thereof adjacent said first grid,
an anode supported on the other surface of said insulator plate adjacent said first photocathode, and
an electrical connection through said insulator plate connecting said anode to said second photocathode.

12. A tube according to claim 1, wherein
a plurality of said elemental portion are disposed in an array, and
said source of biasing light is common to said array.

13. A tube according to claim 12, wherein
said array is supported on a common structural member.

* * * * *